US005386655A

United States Patent [19]

Jones

[11] Patent Number: 5,386,655

[45] Date of Patent: Feb. 7, 1995

[54] BIOGRAPHICAL CALENDAR

[76] Inventor: Kathleen A. Jones, 693 S. Indiana Ave., Kankakee, Ill. 60901

[21] Appl. No.: 125,234

[22] Filed: Sep. 23, 1993

[51] Int. Cl.[6] ..... G09D 3/00

[52] U.S. Cl. ..... 40/119

[58] Field of Search ..... 40/119, 107, 121; 283/2, 3, 4, 115

[56] References Cited

U.S. PATENT DOCUMENTS 1,117,802 11/1914 Deaton ..... 40/119 X
2,228,517 1/1941 Hawkins ..... 40/119
2,626,819 1/1953 Winford ..... 40/119
4,948,034 8/1990 Rohloff ..... 283/2
5,062,229 11/1991 Werjefelt ..... 283/2 X

*Primary Examiner*—James R. Brittain
*Assistant Examiner*—Cassandra Davis

[57] ABSTRACT

An album having pages folded together, one half of each page having photographs attached thereto and the other half of each page having a calendar representing the particular month the photographs were taken. The day of each month in the calendar having light, dotted horizontal lines for writing notes which refer to the photograph.

2 Claims, 1 Drawing Sheet

BIOGRAPHICAL CALENDAR

BACKGROUND OF THE INVENTION

Albums of photographs have been used in the past. However, a disadvantage is that such photographs, except for notes written on the back, have not been readily associated with the event, when taken, or the specific date thereof. Children, particularly when grown, are disappointed in such disadvantage.

An object of my invention is to provide a novel biographical calendar which overcomes such disadvantage.

SUMMARY OF THE INVENTION

The present invention is an album folded in half, in which the top half, when opened, has a plurality of adhesive portions covered by tear strips which, upon tearing off, will expose the adhesive portions to enable easy attachment of photographs. The bottom half has a calendar, preferably one in which a plurality of dotted guide lines are provided for each day of the month to facilitate writing of notes as to the event in one's life represented by a particular photograph.

DESCRIPTION OF THE PREFERRED EMBODIMENT

Figure 1:
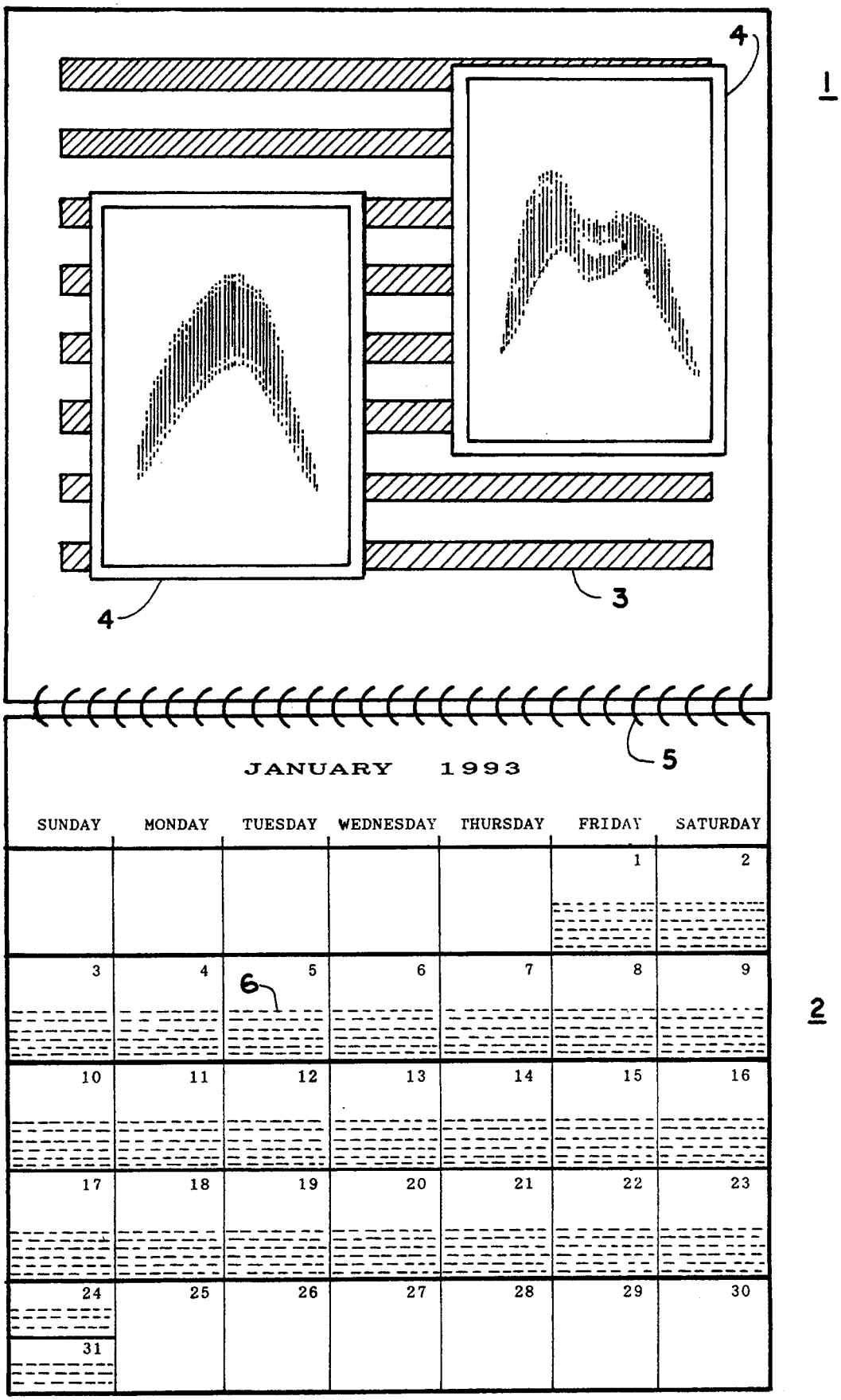
FIG. 1 shows one page of the album of the present invention, when the album is unfolded to show a particular month of the year.

Referring to FIG. 1, numeral 1 denotes the top half of the album for holding photographs, and numeral 2 denotes a calendar of the particular month when the photograph was taken, It should be noted that the reverse may be used instead, that is, that the top half may be the calendar and the bottom half may have photographs adhered thereto showing events occurring during the month represented by the top half. The photographs may be numbered to facilitate referral thereto by notes written in the calendar.

Referring to Fig. 1, numeral 1 denotes the top half and numeral 2 denotes the bottom half of one page of the album of the present invention.

Numeral 3 denotes detachable strips of paper covering adhesive, so that when torn off, the adhesive will be exposed to which photographs 4 may be attached.

Numeral 5 denotes a spiral extending through holes at the fold of the top and bottom halves to enable spacing these halves to accomodate the thickness of photographs, although it should be understood that such spiral may be omitted, in some cases, and the top and bottom halves may be merely folded together. Numeral 6 denotes light dotted lines to facilitate writing notes as to the particular event when the photograph was taken.

A more expensive version which would appeal more to a career woman or man would be to encase or even mount the calendar of the present invention in a leather case and perhaps one having a lock.

I claim:

1. A biographical calendar comprising a calendar having at least one page and an album having an equal number of pages as said calendar, said album being pivotally connected to said calendar, said album having, on each page, a plurality of spaced adhesive portions and a plurality of detachable strips of paper covering said adhesive portions, so that when said strips are torn off, said adhesive will be exposed to enable attachment thereto of photographs, said calendar having dotted horizontal lines associated with date type indicia for writing notes concerning an event occurring on a particular date, said pivotal connection between said album and said calendar comprising spaced holes along an edge of each page and a spiral member extending therethrough.

2. The biographical calendar recited in claim 1 in combination with said photographs and wherein strips of paper and adhesive are arranged in spaced, horizontal relationship.

* * * * *